US012637850B2

(12) United States Patent
Moore

(10) Patent No.: US 12,637,850 B2
(45) Date of Patent: May 26, 2026

(54) TOILET TARGET AND SPLASH REDUCTION APPARATUS

(71) Applicant: Matthew Aaron Moore, Arlington, VA (US)

(72) Inventor: Matthew Aaron Moore, Arlington, VA (US)

( * ) Notice: Subject to any disclaimer, the term of this patent is extended or adjusted under 35 U.S.C. 154(b) by 157 days.

(21) Appl. No.: 18/787,555

(22) Filed: Jul. 29, 2024

(65) Prior Publication Data

US 2026/0028811 A1 Jan. 29, 2026

(51) Int. Cl.
*E03D 9/00* (2006.01)

(52) U.S. Cl.
CPC ..... *E03D 9/00* (2013.01)

(58) Field of Classification Search
CPC E03D 9/00; E03D 9/032; E03D 11/02; E03D 13/005
USPC ..... 4/420, 300.3, 902
See application file for complete search history.

(56) References Cited

U.S. PATENT DOCUMENTS

| | | | | |
|---|---|---|---|---|
| 6,052,840 | A | 4/2000 | West et al. | |
| 6,119,282 | A | 9/2000 | Serbin | |
| D481,448 | S * | 10/2003 | Argentina | D23/297 |
| 7,435,867 | B1 | 10/2008 | Pickett | |
| 10,278,553 | B2 * | 5/2019 | Barringer | A47K 17/00 |
| 10,781,580 | B1 | 9/2020 | Donohue | |
| 11,473,285 | B2 * | 10/2022 | Herbert | E03D 9/00 |
| 2011/0318720 | A1 * | 12/2011 | Giard | A47K 17/00 434/258 |
| 2014/0127657 | A1 | 5/2014 | Traxler | |
| 2015/0040303 | A1 | 2/2015 | Uhm | |
| 2023/0193612 | A1 * | 6/2023 | Ogles | E03D 9/00 4/300.3 |

* cited by examiner

*Primary Examiner* — Huyen D Le

(57) ABSTRACT

A toilet accessory that provides a toilet target and splash reduction. The apparatus is mounted to the side of a toilet bowl, and the target is located inside the bowl, providing a place to aim when urinating. When a stream of urine hits the target, the liquid is dispersed through a mesh and drops into the bowl. The apparatus further comprises a water collector and sanitizing capsule which clean the device each time the toilet is flushed.

6 Claims, 6 Drawing Sheets

TOILET TARGET AND SPLASH REDUCTION APPARATUS

FIELD OF THE INVENTION

The present invention relates generally to toilet attachments and cleaning products. More specifically, the present invention is an attachment that mounts to a toilet and reduces splashing.

BACKGROUND OF THE INVENTION

Toilets are known to be messy and unsanitary, in part due to urine contamination. When men urinate into a toilet bowl from a standing position, undesirable splashing and noise usually occur. Rebounding urine (primary splash) or toilet bowl water upset by a urine stream (secondary splash) leaves the toilet bowl and contaminates the surrounding area. In addition to splashes from the bowl, urine may miss the toilet bowl due to "poor aim", particularly with children who are being toilet trained. All types of urine splash and contamination can make surrounding surfaces grimy and yellow, and can cause rust or contamination of nearby items like towels, cabinets, or toilet paper. All told, both the toilet bowl and the surrounding areas are unsanitary and unsightly.

The present invention seeks to improve cleanliness in three ways: First, it reduces splashing and contamination issues by dispersing the urine stream, reducing rebounding primary splash and eliminating the secondary water splash. Second, it helps train potty training children to improve their aim. And third, it includes a cleaning agent that keep the toilet target and the whole toilet bowl clean.

DETAILED DESCRIPTION OF THE INVENTION

All illustrations of the drawings are for the purpose of describing selected versions of the present invention and are not intended to limit the scope of the present invention.

Figure 1:
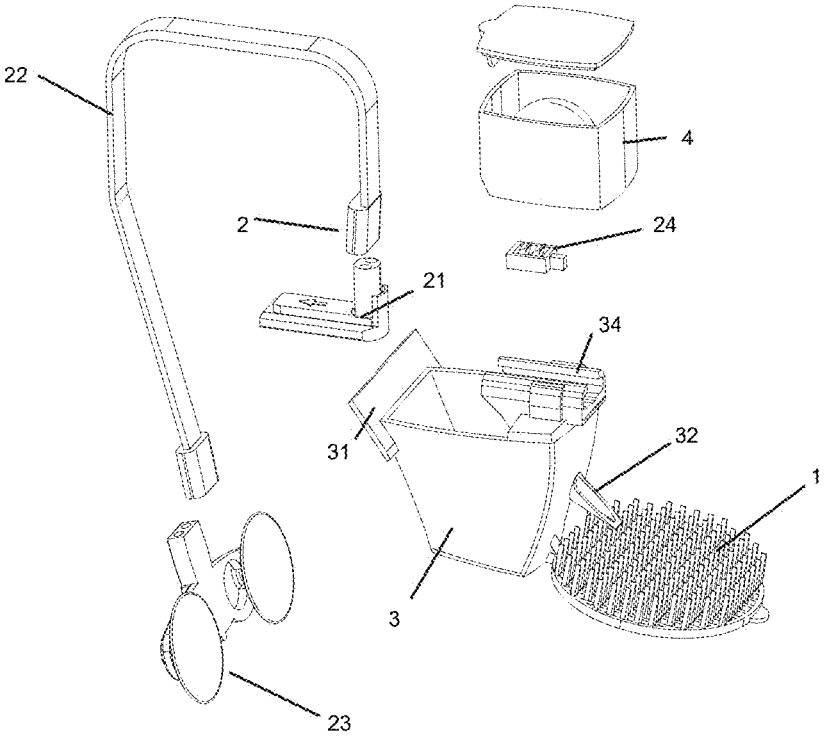
FIG. 1 is an exploded view of the present invention.

The present invention is a toilet target and splash reduction apparatus which mounts to the side of a toilet. FIG. 1 shows an exploded view of the components of the present invention. The present invention comprises a target (1), a mount (2), a water collector (3), and a sanitizer capsule (4). In a preferred embodiment, the mount (2) further comprises a clip (21), an arm (22), and suction cups (23). The water collector (3) further comprises a spout (32) allowing water and cleaning fluid to flow onto the target (1). The present invention keeps the toilet area clean by cleanly dispersing urine streams through the target (1), where the streams then fall into the toilet bowl, reducing splash and sound. The target (1) further provides training utility for children being toilet trained by providing a place to aim.

Figure 2:
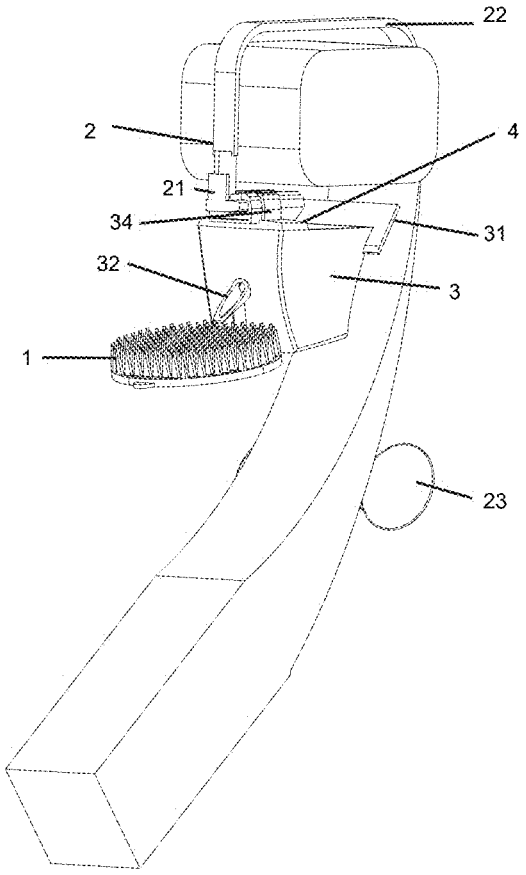
FIG. 2 is cutout view of a section of a toilet to which the present invention is mounted.
Figure 3:
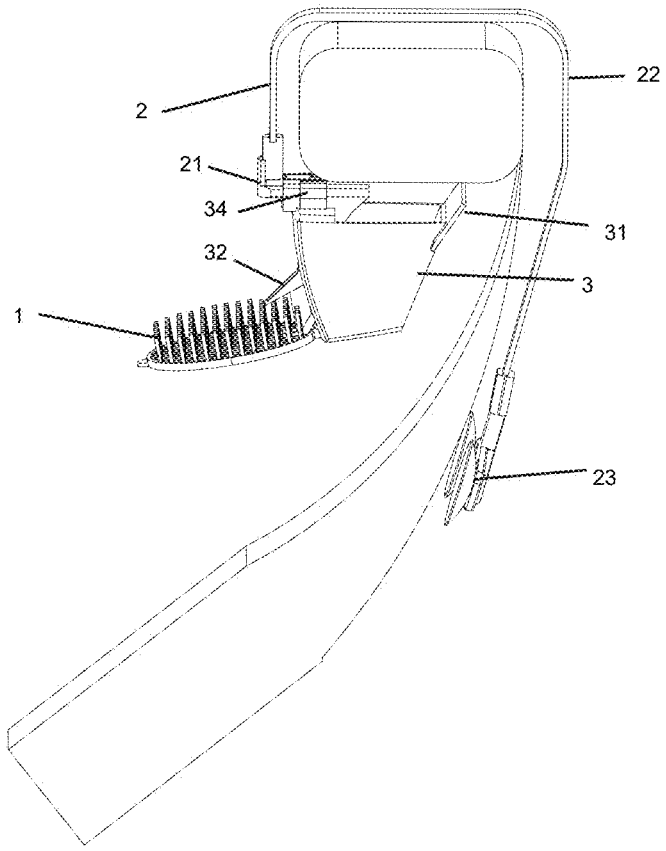
FIG. 3 is a side view of the cutout shown in FIG. 2.
Figure 5:
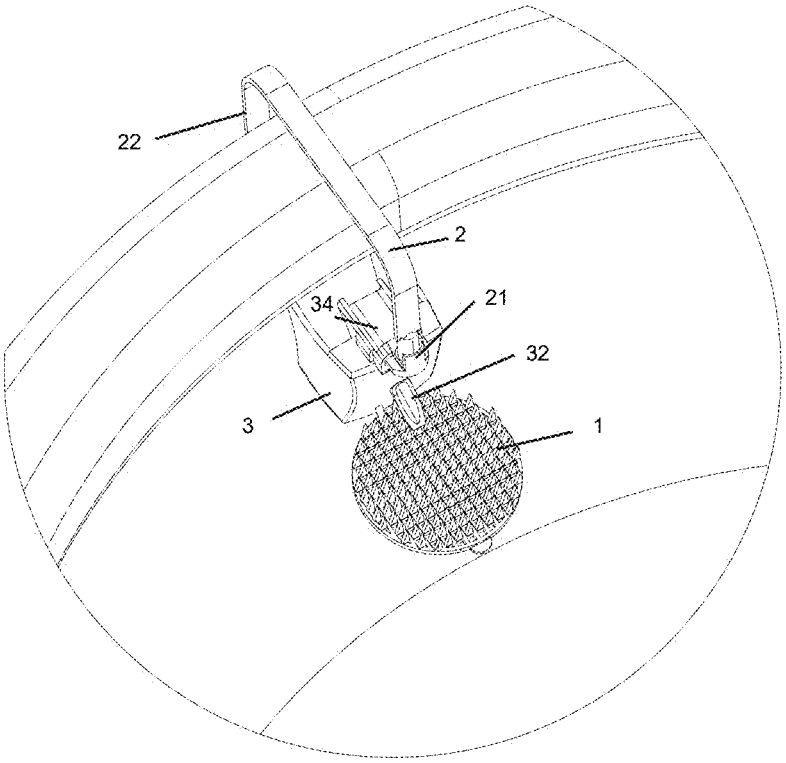
FIG. 5 is a top view of the present invention mounted to a toilet.

FIG. 2 shows the present invention mounted to a toilet. In one embodiment, the target (1) is a round mesh comprising rubber, plastic, or other solid material. The mesh is preferably a horizontal screen mesh with rods or spikes. When a stream of urine hits the target (1), the rods or spikes disperse the stream, which then drips through the mesh and into the toilet bowl, thereby reducing splashing and noise. The target (1) is attached to the water collector (3), which connects to the mount (2). In one embodiment, the mount (2) comprises a clip (21), which allows the water collector (3) and target (1) to be easily attached or detached to the mount (2), an arm (22), which in a preferred embodiment comprises a flexible metal wire, rubber wrap, and plastic frame, and suction cups (23). As shown in FIG. 3, the suction cups (23) stick to the outside of the toilet bowl to hold the apparatus in place. The flexible arm (22) extends around the toilet and is fitted around the rim of the toilet. The water collector (3) and target (1) then slide one-way along between a slide rail (34) and rack with cogs (24), allowing the unit to slide all the way back to the toilet wall, regardless of variation in toilet bowl dimensions. Together these form the main unit that holds firm on the mount (2) so that they hang near the top of the toilet bowl below the rim. As shown in FIG. 5, the target (1) protrudes toward the center of the bowl, and the apparatus is mounted above the water level to prevent unclean toilet water or contents to come into contact with the present invention. The combination of a flexible arm (22), the clip-in slide attachment (21), and the slide rail (34) allow the unit to be shaped to various toilet bowl dimensions. This in turn ensures that the apparatus fits snugly in any toilet regardless of variations in rim shape and dimensions. Additional mounting methods may be possible and should be considered within the scope of the present invention.

Figure 4:
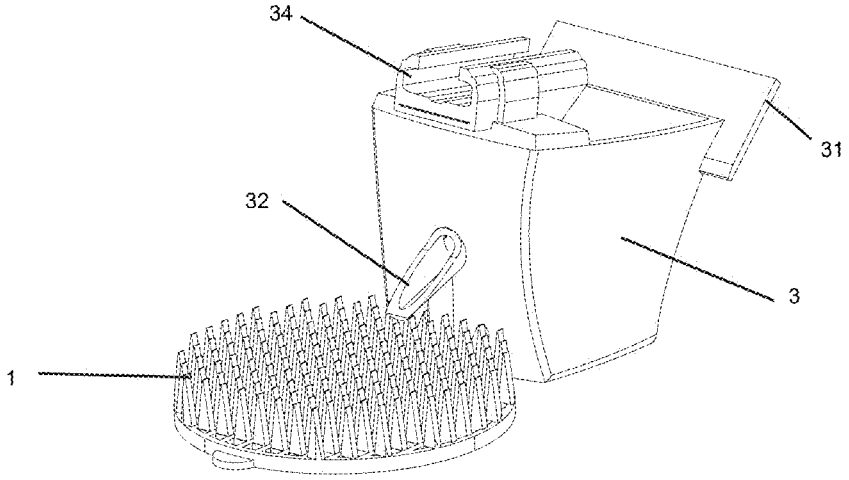
FIG. 4 is a view of the target and water collector of the present invention.
Figure 6:
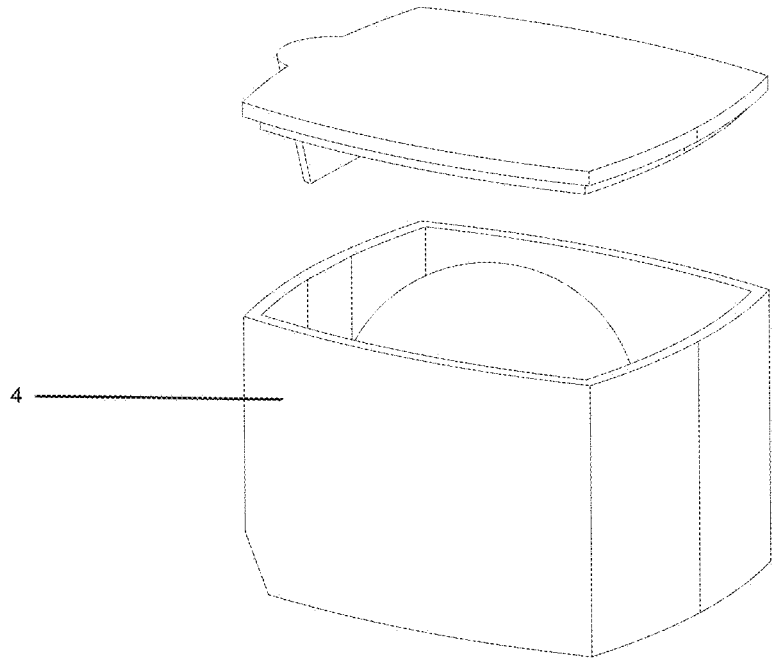
FIG. 6 is an exploded view of the sanitizer capsule of the present invention.

FIG. 6 shows a sanitizer capsule (4) of the present invention. Said capsule (4) may contain a cleaning agent, and the capsule (4) is placed inside the water collector (3). The water collector (3) is shown in FIG. 4. The water collector (3) collects clean water when the toilet is flushed. To ensure that water flows into the collector, the water collector (3) may comprise a rubber seal (31) at the top, which when mounted is flush against the interior wall of the toilet. When the toilet is flushed, clean water flows into the collector, where it may mix with the cleaning agent from the sanitizer capsule (4). Once the water fills the collector, it flows onto the target (1) via a spout (32). This water and chemical mix serves as a rinse for the target, displacing liquid remaining after use, with some water and chemical mix remaining on the target, while most drips down into the bowl. It allows the target (1) to be cleaned upon each flush. The mixture drops into the bowl once the flush is mostly complete, allowing the dose of cleaning chemical to remain in the bowl. Similar products already exist to insert cleaning chemicals into the toilet water reservoir, but they lack the functional splash reduction. Likewise, any splash reduction device would quickly become intolerably contaminated if it did not have a regular cleaning protection.

The target (1) holds a small amount of blue cleaner water within the dispersing mesh. After flushing, the sanitizer mix flows over the mesh, with capillary adhesion holding a remainder of the blue colored water within the mesh. This coloration is displaced by urine in the next use and may make the device more fun for young children who are toilet training, providing a colored target (1) that may change color to indicate that they have hit the target (1). Additional coloration or designs may also be possible to enhance this aspect of the present invention. For example, the target may be formed with embellishments in the image of an animal, such as a turtle. It may also be multicolored, with a colorful ring in the target center to reinforce the target nature of the device. These enhance the visual appeal and increase the likelihood of use in potty-training.

Although the invention has been explained in relation to its preferred embodiment, it is to be understood that many other possible modifications and variations can be made without departing from the spirit and scope of the invention.

What is claimed is:

1. A toilet target and splash reduction apparatus comprising, a target;

a mount, whereby the apparatus is attached to a toilet bowl;

a water collector; and a sanitizer capsule.

2. The apparatus of claim 1, wherein the target comprises, a mesh, a plurality of rubber or plastic rods or studs extending above the mesh, said rods or studs allowing for the dispersal of a stream of urine hitting the target, whereby the dispersed liquid drips through the mesh and into the toilet bowl; and chemical-water mix that flows over the mesh and prevents contamination.

3. The apparatus of claim 1, wherein the mount comprises, a clip, allowing the water collector and target to be attached or detached to the mount;

an arm, said arm comprising flexible material such as polypropylene or metal wire wrapped in rubber or a plastic frame; and suction cups, said suction cups being attached to the end of the arm;

said mount allowing the apparatus to be placed on a toilet, with the suction cups sticking to the outside of the toilet to hold the apparatus in place, the flexible arm fitted around the toilet and over the rim, and the clip on the inside of the toilet bowl near the top, allowing the water collector and target to be attached and extend toward the center of the bowl.

4. The apparatus of claim 1, wherein the water collector comprises, a bowl to collect clean water when the toilet is flushed;

a rubber seal near the top of the water collector, placed so that it is flush to the inside of the bowl and allows water to flow into the collector; and a spout, said spout extending from the bottom of the collector above the target, the target being attached to the bottom of the water collector, allowing the clean water to flow onto and clean the target each time the toilet is flushed.

5. The apparatus of claim 1, wherein the sanitizer capsule comprises a cleaning agent and an anti-sticking agent, said sanitizer capsule being placed inside the water collector, allowing the clean water to mix with the cleaning agent and flow through a spout and onto the target, cleaning the target and the bowl each time the toilet bowl is flushed while minimizing mold adhesion to the target.

6. The apparatus of claim 1, allowing a user to urinate into a toilet bowl while aiming at the target, resulting in reduced noise and splashing, additionally providing young users who are toilet training a challenge to hit the target.

* * * * *